US005217039A

United States Patent [19]

Hoeptner, III

[11] Patent Number: 5,217,039

[45] Date of Patent: Jun. 8, 1993

[54] AUTOMATIC DRAINING BACK FLOW PREVENTER FOR USE WITH GROUND HYDRANT

[76] Inventor: Herbert W. Hoeptner, III, 15085 Venetian Way, Morgan Hill, Calif. 95037

[21] Appl. No.: 885,646

[22] Filed: May 19, 1992

[51] Int. Cl.[5] ..... E03C 1/10

[52] U.S. Cl. ..... 137/218; 137/307

[58] Field of Search ..... 137/217, 218, 307

[56] References Cited

U.S. PATENT DOCUMENTS

| | | | |
|---|---|---|---|
| 196,384 | 10/1877 | Porteous . | |
| 519,728 | 5/1894 | McGowan . | |
| 1,786,357 | 12/1930 | Miller . | |
| 1,987,883 | 1/1935 | White et al. . | |
| 2,174,743 | 10/1939 | Groeniger | 137/217 |
| 2,580,199 | 12/1951 | Schmid . | |
| 2,598,488 | 5/1952 | Bart . | |
| 2,598,968 | 6/1952 | Boosey . | |
| 2,605,781 | 8/1952 | Schmid et al. . | |
| 2,664,096 | 12/1953 | Murdock et al. . | |
| 3,017,896 | 1/1962 | Papacek . | |
| 3,155,107 | 11/1964 | Woodford | 137/218 |
| 3,158,170 | 11/1964 | Tubbs | 137/307 X |
| 3,770,003 | 11/1973 | Uroshevich . | |
| 3,885,585 | 5/1975 | Carpentier . | |
| 4,109,671 | 8/1978 | Hughes et al. . | |
| 4,653,521 | 3/1987 | Fillman . | |
| 4,653,522 | 3/1987 | Fillman et al. . | |
| 4,726,390 | 2/1988 | Franklin | 137/218 |
| 4,854,339 | 8/1989 | Hoeptner, III . | |
| 5,033,500 | 7/1991 | Hoeptner, III . | |
| 5,094,261 | 3/1992 | Giacomini | 137/218 X |

*Primary Examiner*—Gerald A. Michalsky
*Attorney, Agent, or Firm*—William W. Haefliger

[57] ABSTRACT

An automatic draining back flow prevention apparatus comprises tubular body structure having main passage structure between flow entrance and exit ports; the body structure having first and second side ports communicating with the passage structure; first and second diaphragms carried by the body structure to be exposed to flow in the passage structure; a stopper in the passage structure cooperating with the first diaphragm to pass forward fluid flow while a first diaphragm flexes to block exit flow of fluid through the first side ports, and to block back flow of fluid through the main passage structure when the first diaphragm moves to unblock exit flow of fluid through the first side port; the second diaphragm movable to allow in-flow of air through the second side port when the stopper and first diaphragm block back flow of fluid through the main passage structure.

16 Claims, 4 Drawing Sheets

AUTOMATIC DRAINING BACK FLOW PREVENTER FOR USE WITH GROUND HYDRANT

BACKGROUND OF THE INVENTION

The invention relates generally to fluid back flow prevention, and more particularly to a simple, effective, flow controller operating to allow drainage of fluid forward flow while back flow is prevented.

There is need for a simple, effective and reliable back flow preventing device, which also functions to discharge fluid accumulation in a line leading to the device. There is also need to minimize the possibility of freeze-up of fluid accumulation in such a device.

There is additional need for providing a device, as referred to, in combination with a hydrant structure.

SUMMARY OF THE INVENTION

It is a major object of the invention to provide simple, effective flow control structure meeting the above needs. Basically, the device comprises:

a) tubular body means having main passage structure between flow entrance and exit ports, b) the body means having first and second side ports communicating with the passage structure, c first and second diaphragms carried by the body means to be exposed to flow in the passage means, d) a stopper in the passage means cooperating with the first diaphragm to pass forward fluid flow while the first diaphragm flexes to block exit flow of fluid through the first side port, and to block back flow of fluid through the main passage means when the diaphragm moves to unblock exit flow of fluid through the first side port, e) the second diaphragm movable to allow in-flow of air through the second side port when the stopper and first diaphragm block back flow of fluid through the main passage means.

It is another object of the invention to space such diaphragms so as to flex independently, each diaphragm being annular and having its outer periphery retained in fixed position relative to the body means.

Yet another object is to provide the body means to comprise multiple sections that are disconnectible to provide access to the diaphragms; and with a first tubular section having recesses to receive the diaphragms, a second tubular section connected to the first section to retain the first diaphragm in one of the recesses, and a third tubular section connected to the first section to retain the second diaphragm in another of the recesses.

A further object is to provide a simple device, as referred to, wherein the second section has an annular seat thereon to seat the first diaphragm as it flexes to block exit flow of fluid through the first side port. As will be seen, the second section typically also forms the first side port; the first section has another annular seat thereon to normally seat the second diaphragm to block exit flow of fluid through the second side port.

Further objects include the provision of a disc or equivalent support in the body means spaced from the second diaphragm and exposed to the passage interior, the disc seating the first diaphragm as it moves to unblock exit back flow of fluid through the first side port. Spring means ma be carried by the body means to urge the stopper toward the disc, the first diaphragm having an annular portion thereof confined between the stopper and the disc.

These and other objects and advantages of the invention, as well as the details of an illustrative embodiment, will be more fully understood from the following specification and drawings, in which:

DRAWING DESCRIPTION

DETAILED DESCRIPTION

Figure 1:
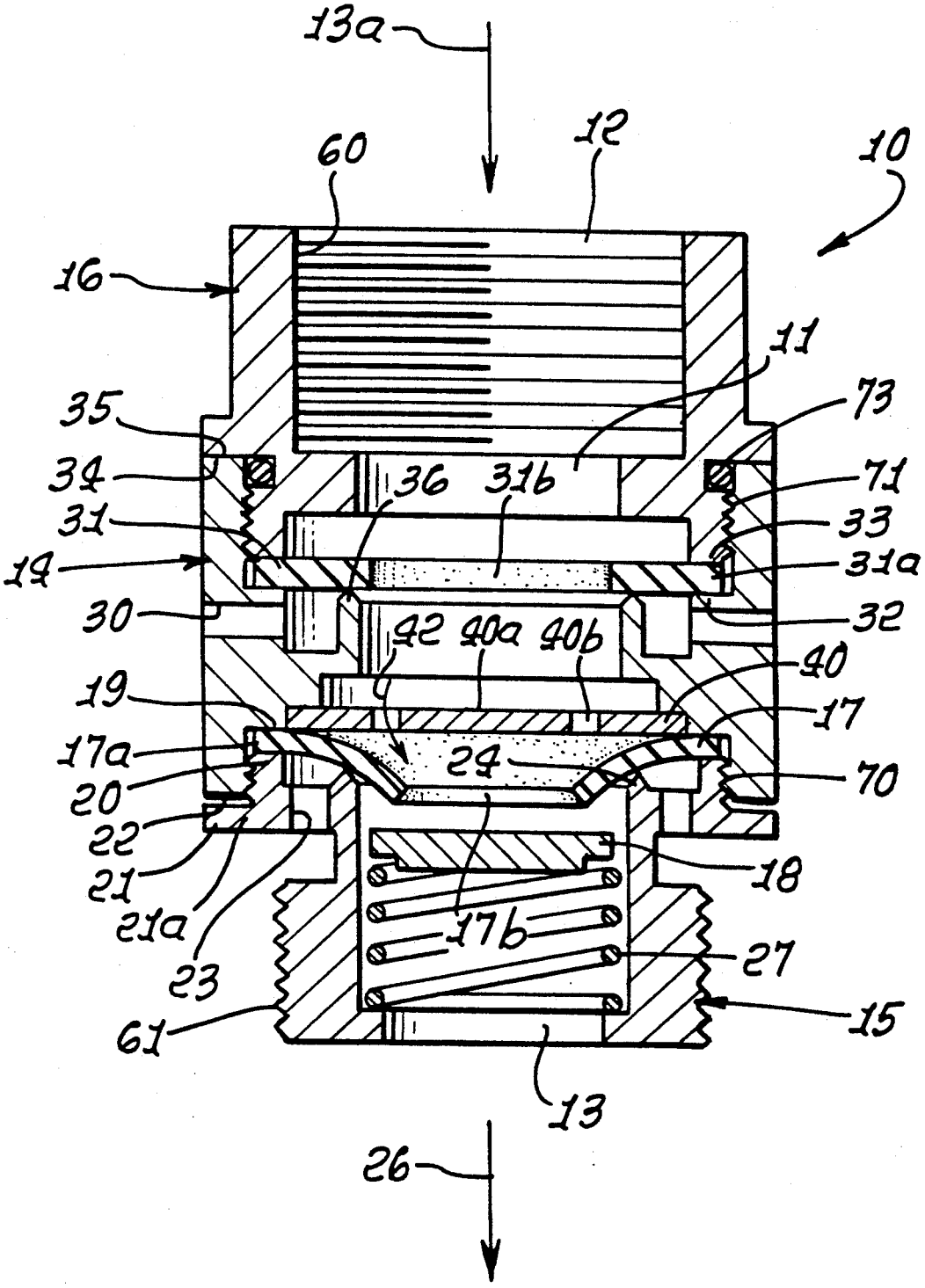
FIG. 1 is a vertical elevation taken in section, showing elements of the invention during forward flow through the device.
Figure 2:
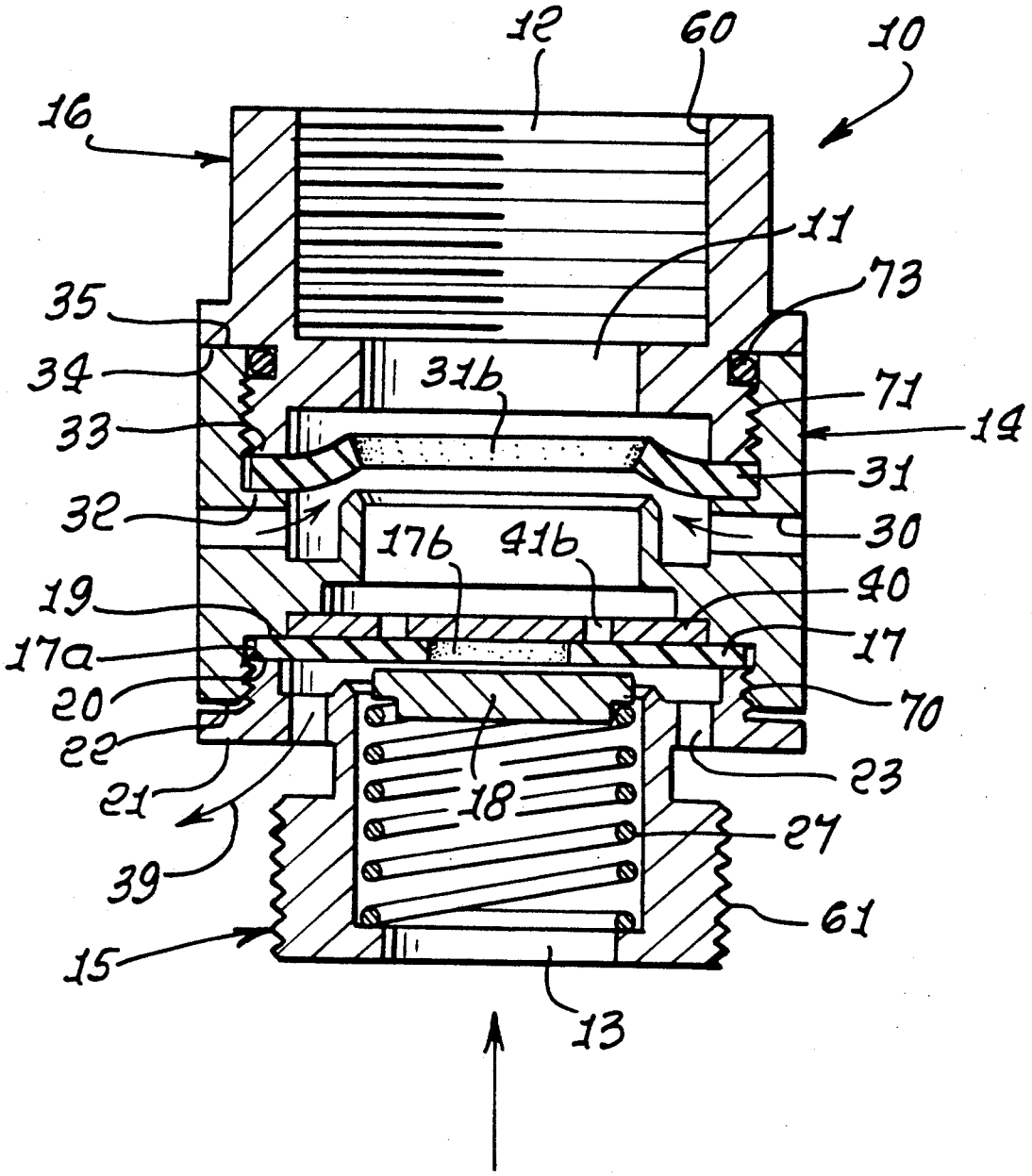
FIG. 2 is a vertical elevation taken in section, showing elements of the invention during back flow discharge.

In FIGS. 1 and 2, a tubular body means 10 has main through passage structure 11 between entrance and exit ports 12 and 13. The direction of forward fluid flow is indicated by arrow 13*a* in FIG. 1. By way of example, the tubular body means may advantageously comprise a first tubular section 14, a second tubular section 15 and a third tubular section 16; and such sections may be assembled in telescoping relation, as in the manner shown. A first flexible diaphragm 17 is carried by the body means to be exposed to flow in the passage means. Also, a stopper 18 is provided in the passage means to cooperate with the first diaphragm to pass forward fluid flow while the first diaphragm flexes forwardly, as seen in FIG. 1. As shown, the first diaphragm is annular and may have its outer annular extent 17*a* retained between annular shoulder 19 formed by the first body section 14 and annular shoulder 20 formed by the second section 15. Flange 21 on the second section engages a rim 22 on the first section to limit closing of shoulder 20 toward shoulder 19 when the diaphragm is forcibly retained between its shoulders. Threads 70 may interconnect 14 and 15.

Body means 10 also forms a first side port or ports 23, as for example in the flange 21 inner extent 21*a*, that port 23 adapted to communicate with the main passage structure in the tubular body prior to diaphragm flexing; however, when the diaphragm is flexed forwardly, as shown in FIG. 1, it blocks exit flow of fluid from the main passage structure through the first side port or ports 23, as seen in FIG. 1. Note that the second body section 15 has a annular seat 24 thereon presented toward the diaphragm and positioned to annularly seat the first diaphragm as it flexes to block exit flow of fluid through the first side port or ports. Under these conditions, flow passes through the diaphragm central opening 17*b*, then around the periphery of the stopper 1 and then outwardly through the exit port 13. See arrow 26. Flow pressure against the stopper displaces it downwardly to allow such flow to pass through central opening 17*b* in diaphragm 17, a compression spring 27 in the second section 15 exerting upward return force on the stopper. That spring is compressed as the stopper is forced downwardly by flow pressure.

The body means also has a second side port or ports 30 for communicating with the interior passage structure 11, as shown in FIG. 2. Under these conditions, the port or ports 30 act to pass in-flow of air to passage 11, second diaphragm 31 flexing upwardly away from annular seat 36 to allow such in-flow. The second diaphragm is normally seated on seat 36, to block exit flow through the second side port or ports 30 in response to the described forward flow of fluid through the main passage means, this condition being shown in FIG. 1. Note that the second diaphragm outer annular extent 31*a* may be captivated between opposed shoulders 32 on the first body section and 33 on the third body section in such manner as to allow the described flexing or movement of the second diaphragm. Interengaged shoulders 34 and 35 of the sections 14 and 16 limit closure of shoulders 32 and 33 to captivate the second diaphragm. Threading at 71 removably connects 14 and 16. See also annular seal 73.

In accordance with an important aspect of the invention, the stopper 18 cooperates with the first diaphragm 17 to block back flow of fluid through the main passage means when the first diaphragm moves upwardly in FIG. 2 to unblock exit back flow of fluid through the first side port 23. See the exit flow arrow 39 in FIG. 2. In this regard, a metallic disc 40 or equivalent support is provided in the body means to extend horizontally, i.e., normal to the flow, and to seat the first diaphragm 17 as it moves upwardly to unblock exit flow of fluid through the first side port 23. The spring 27 then urges the stopper upwardly to engage the underside of the diaphragm 17, closing or blanking its central opening 17*b*, and thereby forcing the upper side of the diaphragm against the disc. The central portion 40*a* of the disc then extends across the diaphragm central opening 17*b* to block the escape of fluid through that opening and the diaphragm blanks escape through disc opening or openings 40*b*. When the diaphragm is displaced downwardly, as in FIG. 1, flow passes through disc opening or openings 40*b* spaced radially outwardly of, or about, the disc central portion 40*a*. See flow arrow 42. Note also that the second annular diaphragm has a central opening 31*b* to pass such flow downwardly, in FIG. 1, and to pass air upwardly in FIG. 2.

In FIG. 2, the second diaphragm 31 is shown as having moved upwardly off the seat 36.

Further features of the invention include the following: the two diaphragms are spaced apart lengthwise of the passage means so that they may flex independently. Each of the diaphragms is annular and has its outer periphery retained in fixed position relative to the body means, the latter having disconnectible sections to provide ready access to the diaphragms for removal and replacement. In this regard, while the sections may have threaded interconnections at 70 and 71, other forms of connection may be provided. Also, the stopper is movable in the passage means free of both of said diaphragms, and in spaced relation thereto.

The invention allows forward flow of fluid without sideward discharge, ports 23 and 30 being sealed, as clearly shown in FIG. 1. In the event of attempted back flow, the FIG. 2 configuration is assumed and such back flow is discharged at 39. The positions of the elements at rest when there is no back flow as are shown in FIG. 2, except that diaphragm 31 engages seat 36, as in FIG. 1. Threaded connections may be provided internally at 60 for connection to upper ducting, and may be provided externally at 61 for connection to lower ducting.

Figure 3:
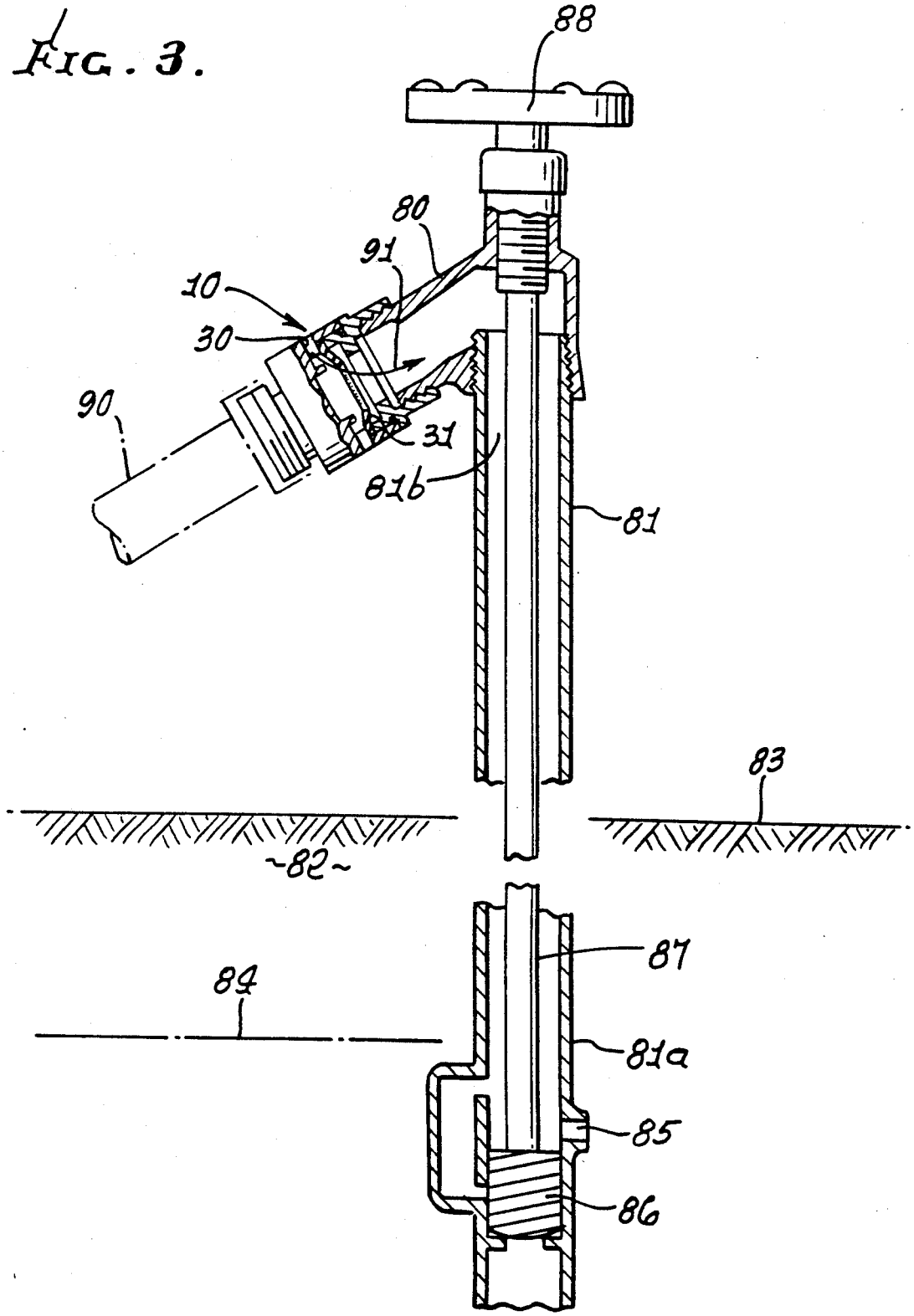
FIG. 3 is a vertical elevation showing a freeze hydrant structure incorporating the draining back flow prevention apparatus in one mode of operation.
Figure 4:
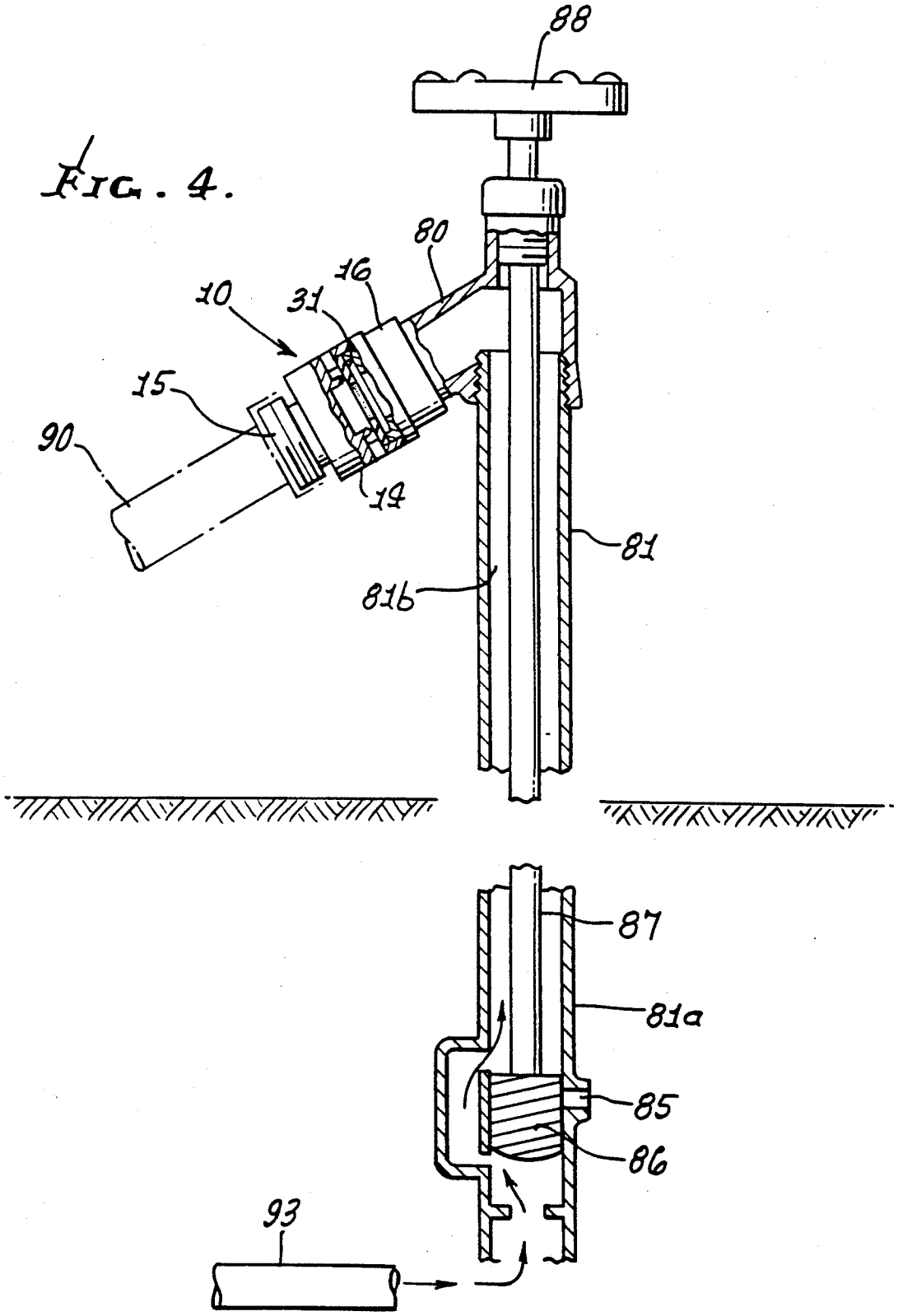
FIG. 4 is a view like FIG. 3 but showing the draining back flow prevention apparatus in another mode of operation.

FIGS. 3 and 4 show the FIG. 1 and FIG. 2 device attached to the tubular hose connection duct 80 integral with the vertical tubular hydrant housing 81, near the upper end of the latter. The housing is installed in the earth 82, to extend above ground level 83, and below front level 84.

In FIG. 3, a drain opening 85 in the side wall 81*a* of the housing 81 is open, i.e., uncovered by a gate 86, on a valve stem 87, axially controlled by an external handle 88. The device 10 is in FIG. 2 mode, so that back flow from a fluid line 90 is blocked, and air in-flow at 91 flows to the housing interior 81*b*, and water in the latter flows out the drain 85.

In FIG. 4, the device 10 is in water forward flow mode of FIG. 1. Water flows from a line 93 beneath the hydrant housing 81, into the lower end of the housing, and about the gate 86, at the side thereof. Water then flows upwardly in 81*b* and sidewardly and downwardly in 80, to pass through device 10, to line 90. Gate 86 closes drain 85 in FIG. 4.

In FIGS. 1 and 2, the diaphragms are typically elastomeric, and the body parts are metallic.

I claim:

1. In automatic back flow prevention apparatus, the combination comprising:

a) tubular body means having main passage structure between flow entrance and exit ports, b) the body means having first and second side ports communicating with said passage structure, c) first and second diaphragms carried by the body mans to be exposed to flow in said passage means, d) a stopper in said passage means cooperating with said first diaphragm to pass forward fluid flow while the first diaphragm flexes to block exit flow of fluid through said main passage mean when said diaphragm moves to unblock exit flow of fluid through said first side port, e) the second diaphragm movable to allow in-flow of air through the second side port when the stopper and first diaphragm block back flow of fluid through the main passage means, f) the first diaphragm having a medial through opening to pass the flow, there being a disc in said body means exposed to said passage means, the disc located directly above said first diaphragm, there being spring means carried by said body means for urging the stopper against the diaphragm to hold the diaphragm engaged against the disc at which time said diaphragm through opening is blanked by the stopper and by the disc in the absence of forward flow pressure exerted on the diaphragm, there being at least one through opening through the disc to pass said pressure to a portion of the diaphragm spaced from said diaphragm medial through opening to effect said flexing of the first diaphragm and to pass said forward flow, said through opening through the disc being blanked by the diaphragm when the diaphragm is held engaged against the disc by the stopper, the stopper bridging said through openings in the disc and diaphragm.

2. The combination of claim 1 wherein the two diaphragms are spaced apart lengthwise of said passage means to flex independently.

3. The combination of claim 1 wherein the each of said diaphragms is annular and has its outer periphery retained in fixed position relative to said body means.

4. The combination of claim 1 wherein said body means comprises multiple sections that are disconnectible to provide access to said diaphragms.

5. The combination of claim 1 wherein said body means comprises a first tubular section having recesses to receive said diaphragms, a second tubular section connected to said first section to retain the first diaphragm in one of said recesses, and a third tubular section connected to said first section to retain the second diaphragm in another of said recesses.

6. The combination of claim 5 wherein said second and third sections have threaded connection to said first section.

7. The combination of claim 6 wherein said second section has an annular seat thereon to seat the first diaphragm as it flexes to block exit flow of fluid through the first side port.

8. The combination of claim 7 wherein said second section also forms said first side port.

9. The combination of claim 6 wherein said first section has an annular seat thereon to normally seat the second diaphragm to block exit flow of fluid through the second side port.

10. The combination of claim 9 wherein the second diaphragm is positioned to be movable away from said first section annular seat to allow said in-flow of air.

11. The combination of claim 9 wherein said first section forms said second side port.

12. The combination of claim 1 the first diaphragm having an annular portion thereof confined between the stopper and the disc, said confined annular portion overlapping said through opening through the disc, at which time the diaphragm extends in a horizontal plane for establishing seals about said openings.

13. The combination of claim 12 wherein the stopper is movable in said passage means free of both of said diaphragms and in spaced relation thereto.

14. The combination of claim 1 including:

f) hydrant structure in combination with said draining back flow prevention apparatus, said hydrant structure including an elongated tubular body, g) said tubular body having its flow entrance in communication with the interior of said elongated tubular body, h) there being a control valve in said elongated tubular body interior, and a weep port toward which fluid drains away from said flow entrance when the valve is closed.

15. The combination of claim 14 wherein the elongated tubular body is installed upright, in the ground, so that said flow entrance is at a higher level than said control valve.

16. The combination of claim 15 including an elongated stem extending in said tubular body, said valve having a valve stopper carried by said stem, and including a handle for the stem, outside said tubular body for moving the stopper in valve controlling relation and in weep hole controlling relation, whereby the weep hole is closed when the valve is open to pass fluid to said flow entrance.

* * * * *